United States Patent [19]

Monaghan

[11] Patent Number: 5,061,214

[45] Date of Patent: Oct. 29, 1991

[54] WATER DISCHARGE DIVERTER FOR OUTBOARD BOAT ENGINES

[76] Inventor: Michael W. Monaghan, 11510 Brandy La., Houston, Tex. 77044

[21] Appl. No.: 574,433

[22] Filed: Aug. 27, 1990

[51] Int. Cl.[5] ..... B63H 21/26

[52] U.S. Cl. ..... 440/88; 440/900

[58] Field of Search ..... 440/53, 49, 88, 900; 441/71

[56] References Cited

U.S. PATENT DOCUMENTS

| | | | |
|---|---|---|---|
| 3,020,568 | 2/1962 | Tierney | 441/71 |
| 3,025,539 | 3/1962 | Kincaid | 441/71 |
| 3,933,114 | 1/1976 | Horn | 440/88 |
| 4,699,596 | 10/1987 | Klinkler et al. | 441/71 |

*Primary Examiner*—Sherman Basinger
*Assistant Examiner*—Stephen P. Avila
*Attorney, Agent, or Firm*—Kenneth A. Roddy

[57] ABSTRACT

A small tubular water discharge diverter has an externally threaded portion at one end for connection to the cooling water discharge port of an outboard engine and is bent along its length to conform generally to the profile of the underside and side wall of the engine exterior. The outer portion of the water discharge diverter is bent upwardly and slightly outward relative to the engine side wall. The engine water pump draws water into the circulation system of the engine from the body of water in which engine is operating where it is circulated through the engine to cool the engine. A portion of the cooling water is discharged through the water discharge diverter and ejected upwardly and outwardly toward the rear in a "rooster tail" which is visible over the top of the engine whereby the discharge water can be easily and conveniently observed by the pilot of the boat from the bow or steering station. The "rooster tale" gives the pilot a visible indication of whether or not the cooling water for the engine is circulating properly, or if the water pump has failed or has become clogged. If the rooster tail begins to change to a brown or darker than normal color, it will indicate that the water pump is drawing in muddy water, silt, or sand, and that the engine is in shallow water or over a sand bar.

18 Claims, 1 Drawing Sheet

WATER DISCHARGE DIVERTER FOR OUTBOARD BOAT ENGINES

BACKGROUND OF THE INVENTION

1. Field of the Invention

This invention relates generally to improvements in outboard engines for motor boat, and more particularly to a small tubular water discharge diverter which is connected to the cooling water discharge port of an engine and directs the discharge water upwardly and outwardly from the rear of the engine in a "rooster tail" which is visible over the top of the engine.

2. Brief Description of the Prior Art

Normally during operation, water is drawn into an outboard motor from the body of water in which the boat is floating by the water pump to cool the engine and a portion of the cooling water is discharged through a small telltale port near the rear of the engine downward into the body of water. The discharge water is directed substantially straight down and can only be seen from the back of the boat. Thus, in many boats the discharge water cannot be seen by the pilot of the boat. As a result, a failed or malfunctioning water pump will often go unnoticed until the engine has been damaged.

It is also common for the propeller or drive shaft of the engine to become damaged when the boat approaches shallow water or a sand bar which is not seen by the pilot.

There are several patents which disclose various flow indicators for engines.

Fahrney, U.S. Pat. No. 1,874,263 discloses a temperature and flow indicator and flow control of cooling water for motors. The apparatus comprises a transparent receptacle which is mounted on the dashboard of the boat remote from the engine and connected to the engine by conduit with a valve disposed therebetween. A thermometer is supported by the receptacle and has a portion projecting therein for displaying the temperature of the circulating water. Closing the valve will restrict circulation and increase the temperature of the cooling water.

Zapf, U.S. Pat. No. 2,370,103 discloses an indicator for indicating whether a fluid pump is effectively operating. The apparatus comprises a movable diaphragm whose position is determined by the pressure of fluid in the pump delivery pipe.

The present invention is distinguished over the prior art in general, and these patents in particular by a small tubular water discharge diverter having an externally threaded portion at one end for connection to the cooling water discharge port of an outboard engine and is bent along its length to conform generally to the profile of the underside and side wall of the engine exterior. The outer portion of the water discharge diverter is bent upwardly and slightly outward relative to the engine side wall. The engine water pump draws water into the circulation system of the engine from the body of water in which engine is operating where it is circulated through the engine to cool the engine. A portion of the cooling water is discharged through the water discharge diverter and ejected upwardly and outwardly toward the rear in a "rooster tail" which is visible over the top of the engine whereby the discharge water can be easily and conveniently observed by the pilot of the boat from the bow or steering station. The "rooster tale" gives the pilot a visible indication of whether or not the cooling water for the engine is circulating properly, or if the water pump has failed or has become clogged. If the rooster tail begins to change to a brown or darker than normal color, it will indicate that the water pump is drawing in muddy water, silt, or sand, and that the engine is in shallow water or over a sand bar.

SUMMARY OF THE INVENTION

It is therefore an object of the present invention to provide a water discharge diverter for the outboard engine of a motor boat.

It is another object of this invention to provide a water discharge diverter for the outboard engine of a motor boat which will allow the pilot of the boat to conveniently observe the water discharge of the engine from the bow or steering station of the boat.

Another object of this invention to provide a water discharge diverter for the outboard engine of a motor boat which will visually indicate whether or not the cooling water for the engine is circulating properly.

Another object of this invention is to provide a water discharge diverter for the outboard engine of a motor boat which will visually indicate whether or not the water pump is in operation.

Another object of this invention is to provide a water discharge diverter for the outboard engine of a motor boat which will visually indicate when the engine is in shallow water or over a sand bar and caution should be taken.

A further object of this invention is to provide a water discharge diverter which may easily and quickly be installed on most existing outboard boat engines without special tools or equipment.

A still further object of this invention is to provide a water discharge diverter for outboard boat engines which is simple in construction, economical to manufacture, and rugged and reliable in use.

Other objects of the invention will become apparent from time to time throughout the specification and claims as hereinafter related.

The above noted objects and other objects of the invention are accomplished by a small tubular water discharge diverter which is connected at one end to the cooling water discharge port of an outboard engine is bent along its length to conform generally to the profile of the underside and side wall of the engine exterior. The outer portion of the water discharge diverter is bent upwardly and slightly outward relative to the engine side wall. A portion of the engine cooling water is discharged through the water discharge diverter and ejected upwardly and outwardly toward the rear in a "rooster tail" which is visible over the top of the engine whereby the discharge water can be easily and conveniently observed by the pilot of the boat from the bow or steering station. The "rooster tale" gives the pilot a visible indication of whether or not the cooling water for the engine is circulating properly, or if the water pump has failed or has become clogged. If the rooster tail begins to change to a brown or darker than normal color, it will indicate that the water pump is drawing in muddy water, silt, or sand, and that the engine is in shallow water or over a sand bar.

DESCRIPTION OF THE PREFERRED EMBODIMENT

Figure 1:
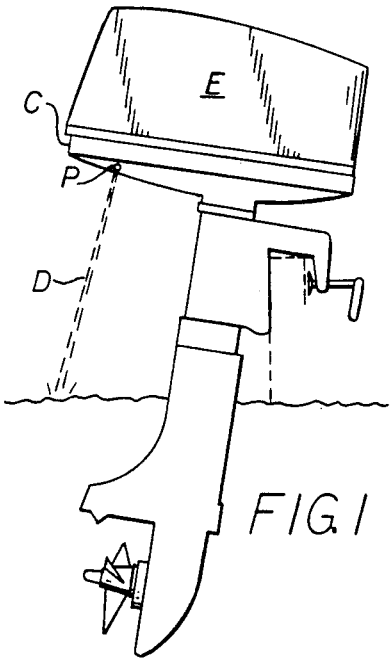
FIG. 1 is a side elevation of a typical outboard engine of the prior art which directs discharge water from a tell tale port down into the water in which it is operating.

Referring to the drawings by numerals of reference, there is shown in FIG. 1, a typical outboard engine E of the prior art in operation. The typical engine E has a cooling water discharge or tell-tale port P extending through the lower engine cover C near the rear of the engine is which is connected to the water circulation system.

During operation, the engine water pump draws water into the circulation system of the engine from the body of water in which engine is operating where it is circulated through the engine to cool the engine. A portion of the cooling water is discharged through the tell-tale port P near the rear of the engine downward into the body of water. The discharge water D is directed substantially straight down and can only be seen from the back of the boat. Thus, the discharge water cannot be seen by the pilot of the boat. As a result, a failed or malfunctioning water pump will often go unnoticed until the engine has been damaged.

Figure 2:
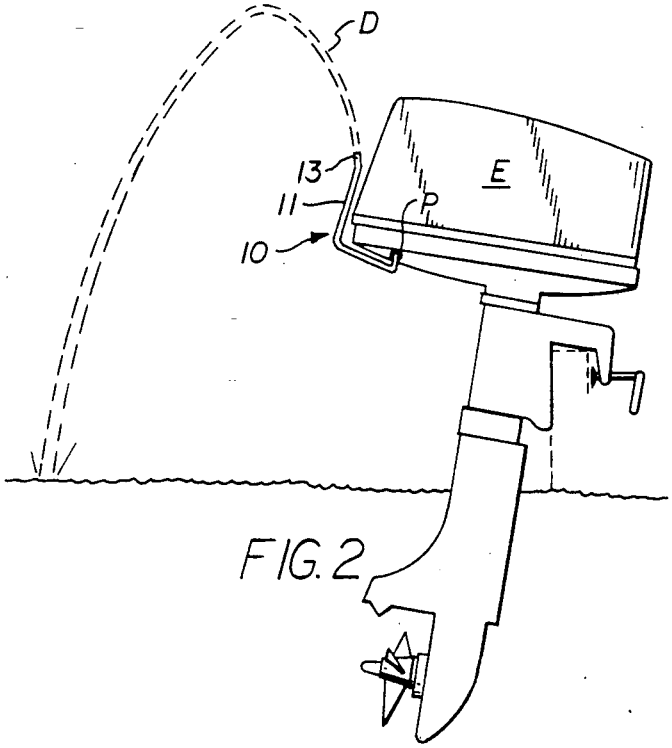
FIG. 2 is a side elevation of a typical outboard engine having a water discharge diverter in accordance with the present invention installed on the tell tale port to direct the discharge water visible upward.
Figure 3:
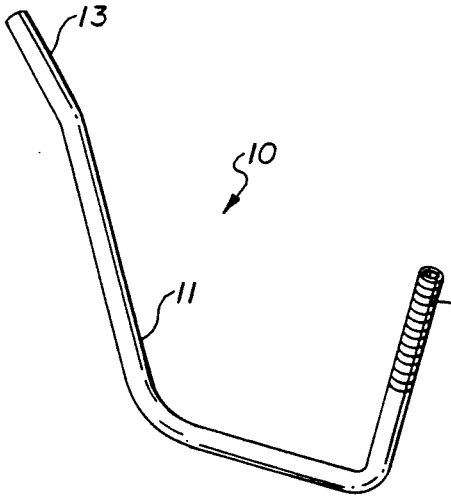
FIG. 3 is an isometric view of a preferred water discharge diverter in accordance with the present invention.
Figure 4:
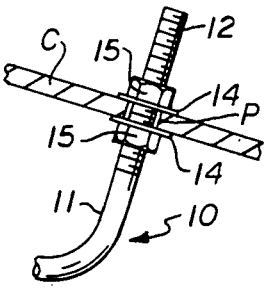
FIG. 4 is a partial cross section showing the connection of the water discharge diverter on the tell tale port of an outboard engine.

Referring now to FIGS. 2, 3, and 4, there is shown in FIG. 2, an outboard engine E which has a water discharge diverter 10 in accordance with the present invention installed. The water discharge diverter 10 is a small tubular member preferably formed of rigid material, such as stainless steel, or rigid plastic.

The tubular body 11 has an externally threaded portion 12 at one end, the inlet end, and is bent along its length to conform generally to the profile of the underside and side wall of the engine cover. The end opposite the threaded portion 12, or outlet end 13 is bent upwardly and slightly outward relative to the engine cover side wall (FIG. 3).

In some applications, a supplimental length of flexible hose may be installed on the outlet end and secured to the engine housing by means of a twist-tie or other conventional fastener to form an extension or to direct the discharge water in a precise direction. A tubing connector may also be installed on the outlet end for connecting an additional length of rigid tubing to the diverter.

To install the diverter 10, the cowling top is removed from the outboard motor. The existing hose is disconnected from the existing discharge aperture. The existing hose holding device, which is usually a rubber grommet or plastic clip on the inside of the cowling is removed.

A first nut 15 and washer 14 is installed on the threaded portion 12 of the diverter 10 and the threaded portion is inserted through the existing hole P of the engine cowling C from the outside of the cowling. A second washer 14 and nut is then installed on the threaded portion 12 of the diverter 10 and firmly tightened with a wrench.

The existing hose is then re-installed on the threaded end 12 extending into the cowling C. The hose may be further secured thereon by a twist-tie or other conventional fastener to prevent the hose from accidently becoming disconnected. The cowling top is then replaced.

OPERATION

During operation, and with the water discharge diverter installed, the engine water pump draws water into the circulation system of the engine from the body of water in which engine is operating where it is circulated through the engine to cool the engine. A portion of the cooling water is discharged through the water discharge diverter 10 and is ejected upwardly and outwardly toward the rear in a "rooster tail" which is visible over the top of the engine (FIG. 2). Thus the "rooster tale" of discharge water D can be easily and conveniently observed by the pilot of the boat from the bow or steering station.

The "rooster tale" will give the pilot a visible indication of whether or not the cooling water for the engine is circulating properly. A strong "rooster tale" will indicate proper operation, while a weak or small rooster tale will indicate some abnormality. If there is no rooster tale, or if it suddenly stops, there is a strong possibility that the water pump has failed or has become clogged. Thus the engine can immediately be shut down to prevent further damage to the engine.

Another feature of the water discharge diverter 10 is that it will indicate when the boat is in shallow water or over a sand bar which may not normally be seen by the pilot. For example, if the rooster tail begins to change to a brown or darker than normal color, it will indicate that the water pump is drawing in muddy water, silt, or sand, and that the engine is in shallow water or over a sand bar and the pilot can change direction or shut down the engine.

While this invention has been described fully and completely with special emphasis upon a preferred embodiment, it should be understood that within the scope of the appended claims the invention may be practiced otherwise than as specifically described herein.

I claim:

1. A water discharge diverter for outboard engines of motor boats of the type having a water circulation cooling system and a cooling water discharge port, the diverter comprising;

a tubular member having an inlet end adapted to be connected to the cooling water discharge port in fluid communication with the engine circulation system and curved upwardly and outwardly along its length to conform generally to the profile of the engine exterior, and an outlet end positioned slightly outward relative to the side wall of the engine exterior to expel the engine discharge water flowing therethrough upward and outward from the rear of the engine in an arcuate path which is visible over the top of the engine such that it can be observed from the bow or steering station of the boat by the boat pilot.

2. A water discharge diverter according to claim 1 wherein said tubular member is formed of rigid material.

3. A water discharge diverter according to claim 2 wherein said rigid material is stainless steel.

4. A water discharge diverter according to claim 2 wherein said rigid material is plastic.

5. A water discharge diverter according to claim 1 wherein said tubular member is configured to conform generally to the profile of the underside and side wall of the engine exterior and said outlet end is positioned slightly outward relative to the side wall of the engine exterior.

6. A water discharge diverter according to claim 1 wherein said tubular member is formed of a length of rigid material bent along its length to conform generally to the profile of the underside and side wall of the engine exterior and said outlet end is bent upwardly and slightly outward relative to the side wall of the engine exterior.

7. A water discharge diverter according to claim 1 wherein said tubular member inlet end is externally threaded for connection to the cooling water discharge port of the engine.

8. A water discharge diverter according to claim 1 wherein said tubular member is formed of a length of rigid material externally threaded at said inlet end for threaded connection to the cooling water discharge port of the engine and bent along its length to conform generally to the profile of the underside and side wall of the engine exterior and said outlet end is bent upwardly and slightly outward relative to the side wall of the engine exterior.

9. In combination with an outboard engine for motor boats having a water circulation cooling system and a cooling water discharge port, a water discharge diverter for the system comprising;

a tubular member having an inlet end adapted to be connected to the cooling water discharge port in fluid communication with the engine circulation system and curved upwardly and outwardly along its length to conform generally to the profile of the engine exterior, and an outlet end positioned slightly outward relative to the side wall of the engine exterior to expel the engine discharge water flowing therethrough upward and outward from the rear of the engine in an arcuate path which is visible over the top of the engine such that it can be observed from the bow or steering station of the boat by the boat pilot.

10. The combination according to claim 9 wherein said tubular member is formed of rigid material.

11. The combination according to claim 10 wherein said rigid material is stainless steel.

12. The combination according to claim 10 wherein said rigid material is plastic.

13. The combination according to claim 9 wherein said tubular member is configured to conform generally to the profile of the underside and side wall of the engine exterior and said outlet end is positioned slightly outward relative to the side wall of the engine exterior.

14. The combination according to claim 9 wherein said tubular member is formed of a length of rigid material bent along its length to conform generally to the profile of the underside and side wall of the engine exterior and said outlet end is bent upwardly and slightly outward relative to the side wall of the engine exterior.

15. The combination according to claim 9 wherein said tubular member inlet end is externally threaded for connection to the cooling water discharge port of the engine.

16. The combination according to claim 9 wherein said tubular member is formed of a length of rigid material externally threaded at said inlet end for threaded connection to the cooling water discharge port of the engine and bent along its length to conform generally to the profile of the underside and side wall of the engine exterior and said outlet end is bent upwardly and slightly outward relative to the side wall of the engine exterior.

17. An outboard engine for motor boats comprising;

a water circulation cooling system including a water pump for drawing water into the circulation system of the engine from the body of water in which engine is operating and circulating the water about the engine to cool the engine during operation, a cooling water discharge port connected to the circulation system for discharging the circulated water back into the body of water from which it was drawn, a water discharge diverter connected to the cooling water discharge port in fluid communication with the engine circulation system, said water discharge diverter curved along its length and having an outlet end positioned slightly outward relative to the engine side wall to expel the engine discharge water flowing therethrough upward and outward from the rear of the engine in an arcuate path which is visible over the top of the engine such that it can be observed from the bow or steering station of the boat by the boat pilot.

18. An outboard engine according to claim 17 in which said water discharge diverter forms an extension of the cooling water discharge port and is configured to conform generally to the profile of the underside and side wall of the engine exterior and said outlet end is positioned slightly outward relative to the side wall of the engine exterior.

* * * * *